US008967396B2

(12) United States Patent
Noraker

(10) Patent No.: US 8,967,396 B2
(45) Date of Patent: Mar. 3, 2015

(54) FISHING ROD HANGING SYSTEM

(75) Inventor: Alan G. Noraker, Westminster, CO (US)

(73) Assignee: Wright & McGill Co., Denver, CO (US)

( * ) Notice: Subject to any disclaimer, the term of this patent is extended or adjusted under 35 U.S.C. 154(b) by 101 days.

(21) Appl. No.: 13/426,447

(22) Filed: Mar. 21, 2012

(65) Prior Publication Data

US 2012/0241396 A1 Sep. 27, 2012

Related U.S. Application Data

(60) Provisional application No. 61/466,833, filed on Mar. 23, 2011.

(51) Int. Cl.

| | |
|---|---|
| ***A47F 7/00*** | (2006.01) |
| ***A47F 5/00*** | (2006.01) |
| ***B65D 73/00*** | (2006.01) |

(52) U.S. Cl.

CPC ..... *A47F 5/0006* (2013.01); *B65D 73/0064* (2013.01); *A47F 7/0021* (2013.01)

USPC ..... 211/70.8; 43/21.2; 206/315.11

(58) Field of Classification Search

CPC ..... A47F 5/0006; A47F 2005/0012; A47F 7/0021; A47F 7/0028; B65D 73/0064; B65D 73/0071

USPC ..... 211/70.8, 60.1, 64, 65, 67, 68, 70.2, 211/70.5, 59.1, 57.1, 113, 116, 117, 211/119.004; 224/922; 43/21.2, 26; 248/512; 206/315.11, 461

See application file for complete search history.

(56) References Cited

U.S. PATENT DOCUMENTS

| | | | | |
|---|---|---|---|---|
| 1,761,497 | A * | 6/1930 | Smith | 224/222 |
| 2,595,230 | A * | 5/1952 | Daviau | 43/26 |
| 3,282,482 | A * | 11/1966 | Scharsu | 224/605 |
| 3,508,357 | A * | 4/1970 | Collin et al. | 43/26 |
| 4,359,161 | A * | 11/1982 | Sinoff | 206/315.11 |
| 4,529,112 | A * | 7/1985 | Miller | 224/610 |
| 4,586,615 | A * | 5/1986 | Quitmann | 211/70.6 |
| 5,366,076 | A | 11/1994 | Lyles | |
| 5,797,212 | A * | 8/1998 | Kistner et al. | 43/21.2 |
| D437,617 | S * | 2/2001 | Rosenthal | D20/22 |
| 6,467,617 | B1 | 10/2002 | Chen | |
| 6,637,591 | B2 * | 10/2003 | Chen | 206/349 |
| D655,152 | S | 3/2012 | Noraker | |
| 8,322,529 | B2 * | 12/2012 | Titkos et al. | 206/497 |
| 2004/0049968 | A1 * | 3/2004 | Barginear | 43/26 |
| 2004/0108235 | A1 * | 6/2004 | Lukas | 206/315.11 |
| 2006/0016771 | A1 * | 1/2006 | Plzak | 211/70.6 |

OTHER PUBLICATIONS

Notice of Allowance and Fee(s) Due for U.S. Appl. No. 29/388,085, mailed Dec. 2, 2011, 12 pages.

* cited by examiner

*Primary Examiner* — Korie H Chan
(74) *Attorney, Agent, or Firm* — Sheridan Ross P.C.

(57) ABSTRACT

A fishing rod hanging system is provided. More particularly, a hanger member including a hanger plate and a plurality of rails is provided. The rails generally extend in a first direction from the hanger plate, and can have different lengths. Fastener holes and/or integrated fastener members are provided on the rails. The fastener holes and/or integrated fastener members can be adapted to hold sections of a fishing rod. An accessory package can also be provided that is attached to ends of the fishing rod sections opposite ends attached to the hanger member.

17 Claims, 8 Drawing Sheets

FISHING ROD HANGING SYSTEM

CROSS-REFERENCE TO RELATED APPLICATIONS

This application claims the benefit of U.S. Provisional Patent Application Ser. No. 61/466,833, filed Mar. 23, 2011, the entire disclosure of which is hereby incorporated herein by reference.

FIELD

The present invention is directed to a fishing rod hanging system.

BACKGROUND

Fishing rods are commonly displayed in racks or free standing displays. For example, rod racks may be positioned behind a sales counter. However, this requires that the retail establishment have high ceilings. As another example, rods can be placed in free standing displays accessible to potential buyers. Although this configuration allows the butt end of the rods to be placed on or near the floor, like dedicated rod racks, rod displays require specialized fixtures. Because of this, retailers that are not focused on fishing or sporting goods may be reluctant to stock fishing rods for sale. Accordingly, potential sales outlets, such as general or convenience stores located near desirable fishing locations, often forgo the opportunity to sell fishing rods to customers.

SUMMARY

Embodiments of the present invention provide a system for the display of fishing rods that allows fishing rods to be displayed on a conventional pegboard or hanging rack. In particular, the system as disclosed herein provides a hanger member that includes a plurality of rails to which the sections of a rod can be attached. Some or all of the rails may feature a plurality of fastener holes, for receiving a fastener member at any of a number of locations along the length of the rail that can be used to attach one or more rod sections to the hanger member. Moreover, some or all of the rails can incorporate a clip or integrated fastener structure for attaching one or more rod sections to the hanger member. In accordance with further embodiments, some or all of the rails can include a stop plate. The hanger member can include one or more apertures, to facilitate interconnecting the hanger member and the attached rod from a hook or rail, including fixed members, or members attached to a pegboard, slat board or other configurable system.

In accordance with further embodiments of the present invention, the fishing rod hanging system can include or be associated with an auxiliary package. As an example, the auxiliary package can comprise a container such as a blister package that encloses at least a portion of some or all of the rod sections. Moreover, the blister package can be positioned at an end of the rod sections opposite the end of those sections at which the hanger member is fixed to the rod. The auxiliary package can also hold additional items. For example, a reel, lures, line, or other fishing tackle, accessories, instructions, or the like, can be held within or attached to the auxiliary package. In accordance with further embodiments of the present invention, the auxiliary package extends along a portion of the rod section that is less than the length of any one rod section. Accordingly, the need to provide large, wasteful blister packages or enclosures is avoided.

Additional features and advantages of embodiments of the present invention will become more readily apparent from the following description, particularly when taken together with the accompanying drawings.

DETAILED DESCRIPTION

Figure 1:
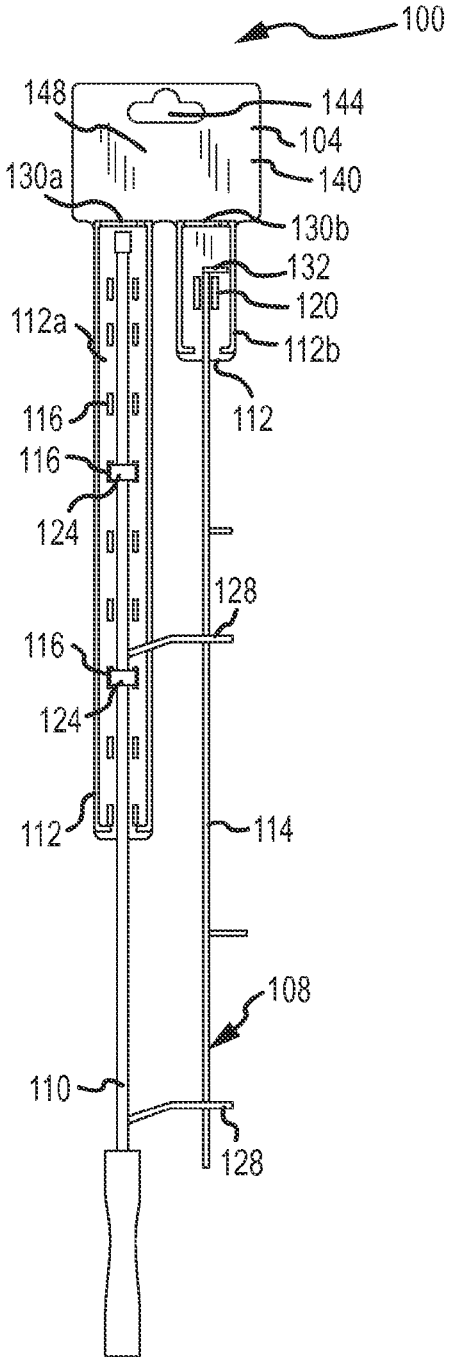
FIG. 1 illustrates a hanger member for display of fishing rods with an interconnected rod in accordance with embodiments of the present invention.

FIG. 1 is a front plan view of a fishing rod hanging system 100 that includes a hanger member 104 for display of fishing rods in accordance with embodiments of the present invention, with a fishing rod 108 attached thereto. In general, the hanger member 104 includes a plurality of parallel rails 112. The rails 112 in the embodiment shown in FIG. 1 include a first rail 112*a* with a plurality of fastener holes 116 and a second rail 112*b* with an integrated fastener member 120. In the illustrated embodiment, the fastener holes 116 of the first rail 112*a* are arranged in pairs that are configured to receive a fastener or fastener member 124 that acts to secure a rod 108 section to the rail 112*a*. In this example, the fastener 124 comprises a zip or cable tie, and two fasteners 124 are used at different locations along the length of the rail 112*a* to secure the rod 108 section. As can be appreciated by one of skill in the art after consideration of the present disclosure, securement at multiple locations can be desirable to provide stability and a secure attachment of the rod 108 section to the rail 112*a*. Moreover, by spacing fastener holes 116 at different locations along the length of the rail 112*a*, different pairs of fastener holes 116 can be selected according to those that best accommodate the rod 108 section attached to the rail 112*a*. In particular, it can be desirable to provide a fastener hole 116 proximate to a rod guide 128 between the fastener hole 116 and a first stop plate 130*a*, to confine movement of the rod 108 section in a direction parallel to the longitudinal axis of the rail 112*a* and the rod 108 section. In the example illustrated in FIG. 1, a butt or handle section 110 of the rod 108 is attached to the first rail 112*a*.

The second rail 112*b* includes an integrated fastener 120 that in this example comprises a clip. The integrated fastener 120 receives a tip portion or section 114 of the rod 108. Accordingly, the tip section 114 of the rod 108 can be snapped into the fastener 120. Thus attached, the end or tip guide 132 of the tip section 114 of the rod 108 is between the integrated fastener 120 and a second stop plate 130*b* that is associated with the second rail 112*b*. As shown in the figure, the tip section 114 of the rod 108 can be positioned such that it extends through guides 128 of the butt section 110 attached to the first rail 112*a*.

The hanger member 104 includes a hanger plate 140 that provides a structure for interconnecting the first 112*a* and second 112*b* rails. In addition, the hanger plate 140 includes an aperture or hanger aperture 144 for receiving a hook, rail, or other display fixture member. In the example of FIG. 1, the aperture 144 is shown as a closed aperture. However, embodiments can provide an aperture 144 that is open, for example to facilitate hanging the hanger member 104 from a rack. In accordance with still other embodiments, the hanger plate 140 can comprise a separate hook that is fixed to the hanger plate 140. In accordance with still other embodiments, multiple apertures 144 may be provided. As shown, the hanger plate 140 can also include a display area 148. For example, the display area 148 may comprise a planar area or surface between the hanger aperture 144 and the rails 112, to provide space for a label.

The rails 112 may have different lengths. For example, as shown in FIG. 1, the first rail 112*a* may extend for a first distance or length from the hanger plate 140, while the second rail 112*b* may extend for a second distance or length from the hanger plate 140 that is less than the first length. Moreover, the rails 112 can be integrated with (i.e., formed from the same piece of material as) the hanger plate 140.

Figure 2:
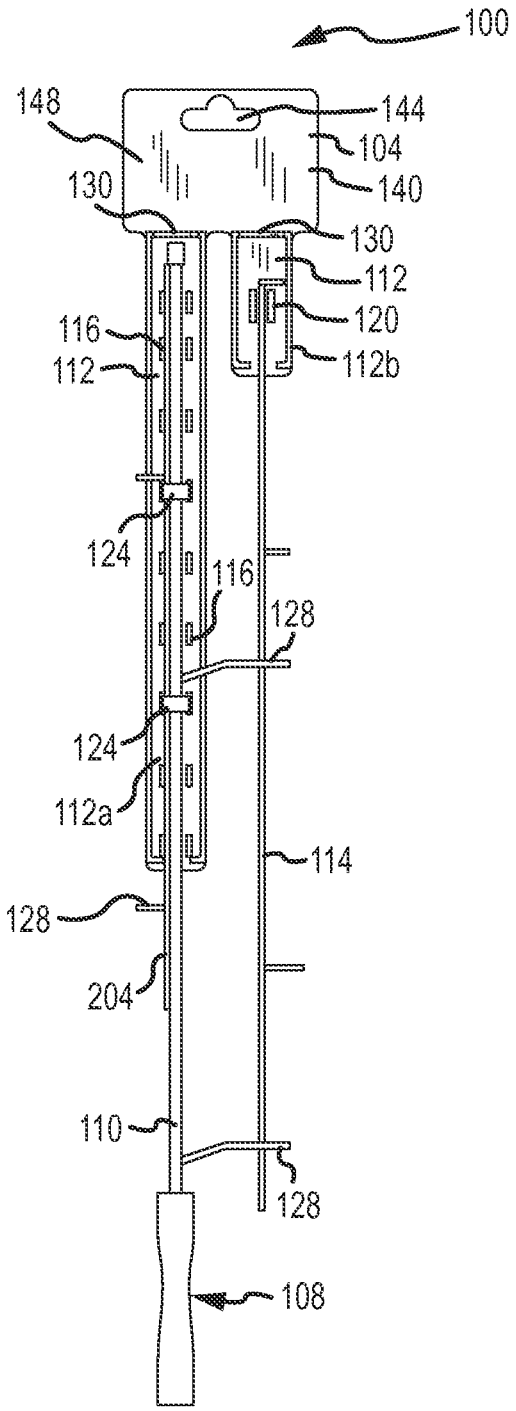
FIG. 2 illustrates a hanger member for display of fishing rods with an interconnected rod in accordance with other embodiments of the present invention.

FIG. 2 illustrates a fishing rod hanging system 100 incorporating a hanger member 104 in accordance with further embodiments of the present invention. In particular, the hanger member 104 in FIG. 2 is shown with a three-piece or section rod 108 attached thereto. In this example, the butt section 110 and a middle section 204 are both interconnected to the first rail 112*a* of the hanger member 104. The tip section 114 of the rod 108 is interconnected to the second rail 112*b*. Accordingly, rods 108 with three or more sections can be interconnected to a hanger member 104 with fewer rails 112 than rod 108 sections. In accordance with still other embodiments, additional rails 112 may be provided.

Figure 3:
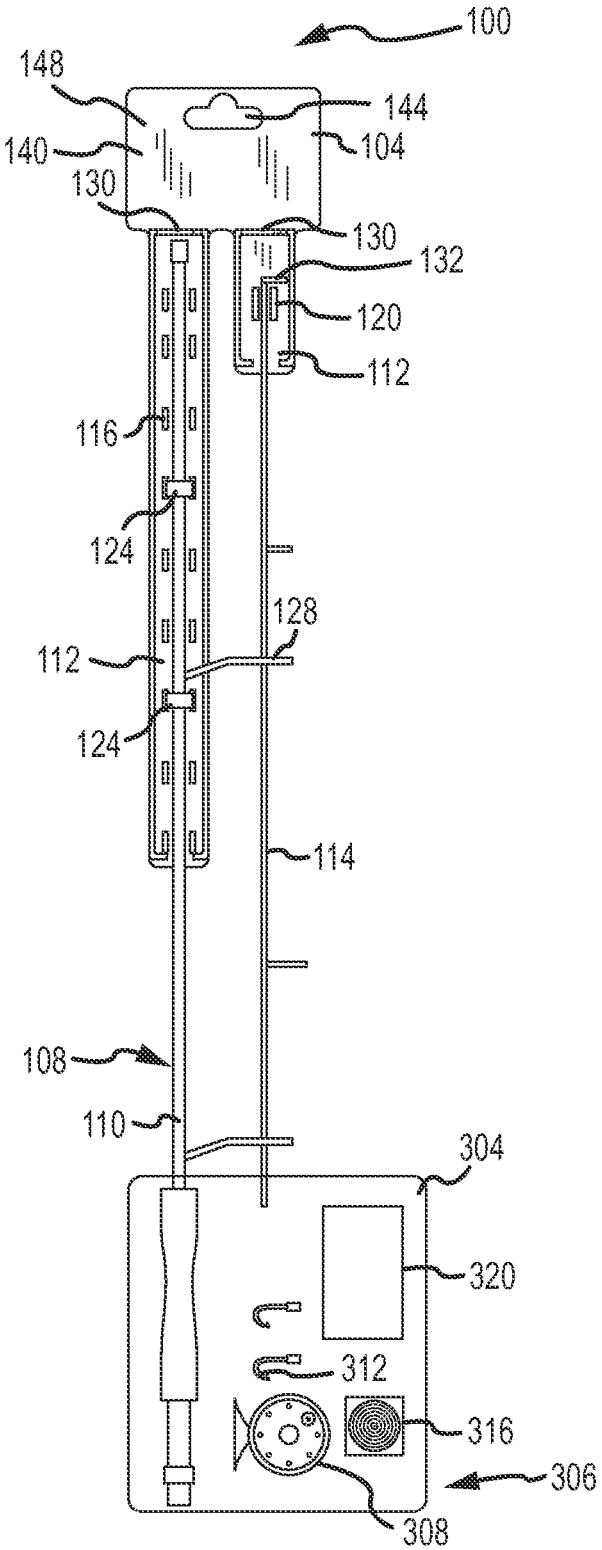
FIG. 3 illustrates a hanger member for display of fishing rods with an interconnected rod and an auxiliary package in accordance with embodiments of the present invention.

FIG. 3 illustrates a fishing rod hanging system 100 incorporating a hanger member 104 in accordance with still other embodiments of the present invention. More particularly, the embodiment of FIG. 3 is associated with an auxiliary package 304 that is interconnected at or towards an end of the rod 108 sections opposite the ends of the rod 108 sections proximate to the hanger plate 140. In this configuration, the rod 108 provides a structure that interconnects the hanger member 104 to the auxiliary package 304. Accordingly, FIG. 3 is an example of a fishing rod hanging system 100 that includes an auxiliary package 304, in combination with a hanger member 104 and a rod 108. An auxiliary package 304 in accordance with embodiments of the present invention can enclose or provide an attachment point for accessory or other items 306. For example, the auxiliary package 304 can provide packaging or an attachment point for a reel 308, flies or other lures 312, fishing lines 316, instructions 320, or any other accessory items 306 that are included as part of a package or kit. The auxiliary package 304 can, at least in some embodiments, comprise a blister type package that holds the accessory items 306. In accordance with at least some embodiments, the auxiliary package 304 extends for only a portion of the length of the interconnected rod 108 sections. For example, the auxiliary package 304 can be interconnected to the hanger member 104 by the sections of the rod 108, but need not be in direct contact with the hanger member 104.

Figure 4:
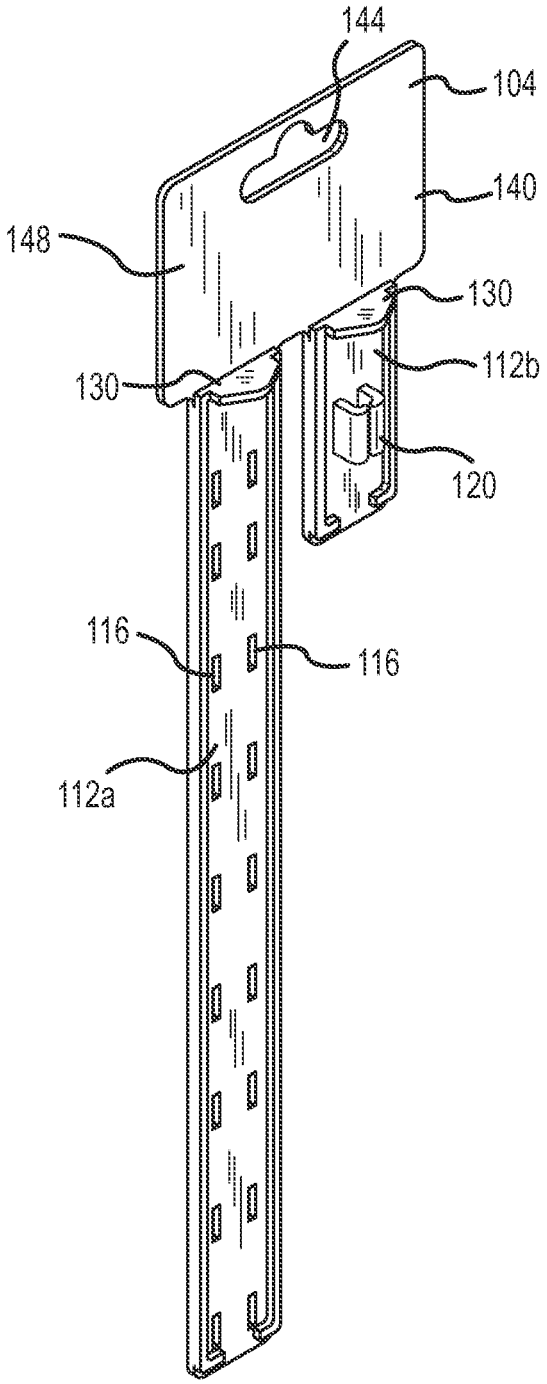
FIG. 4 is a front perspective view of a hanger member for display of fishing rods in accordance with embodiments of the present invention.
Figure 5:
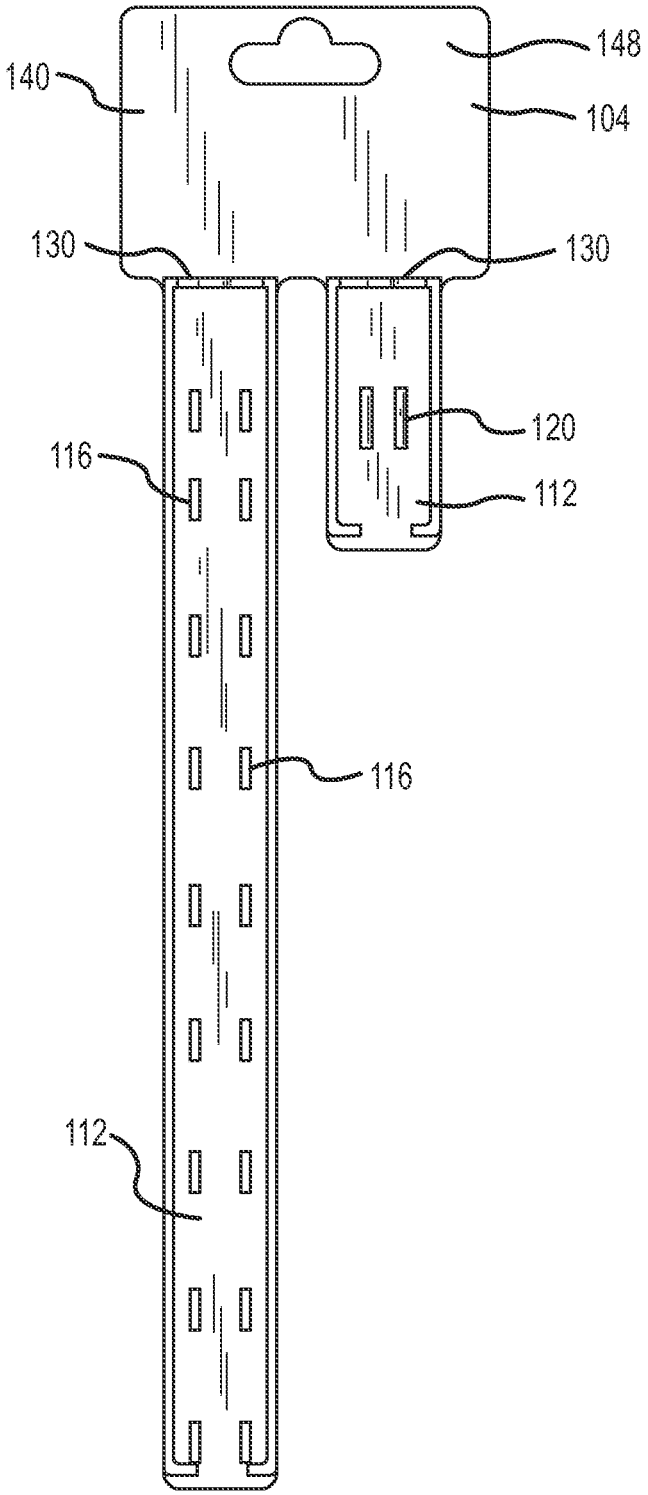
FIG. 5 is a front side plan view of a hanger member for display of fishing rods in accordance with embodiments of the present invention.
Figure 6:
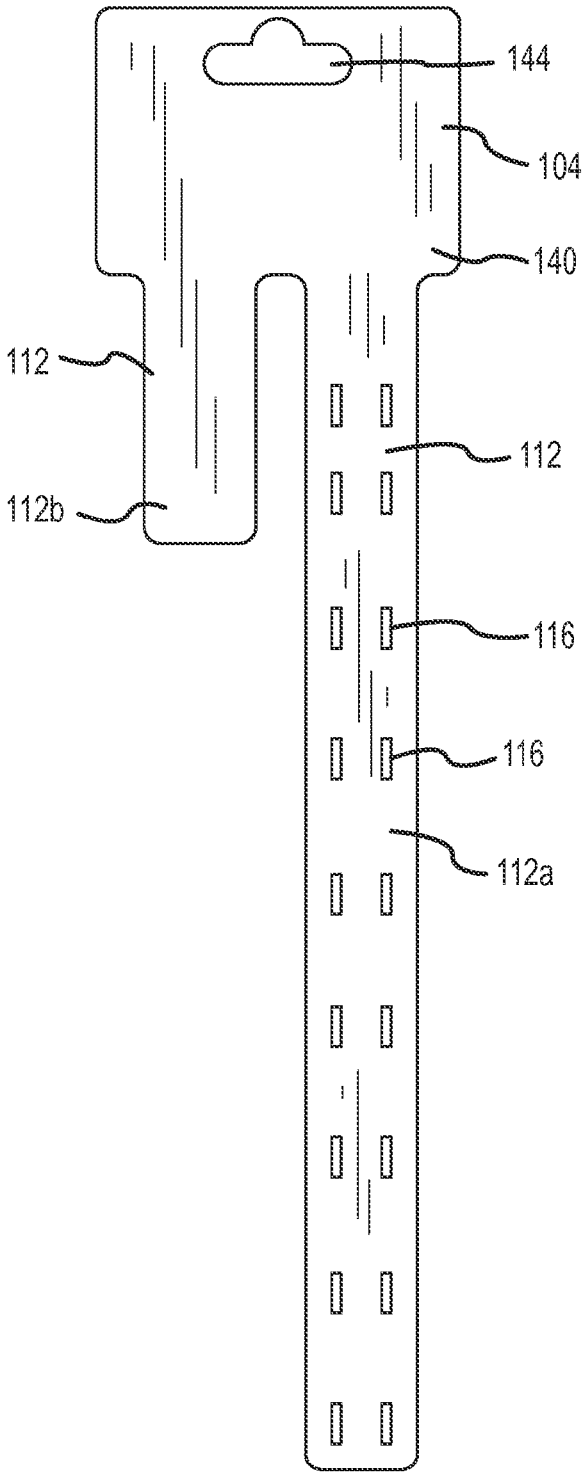
FIG. 6 is a back side plan view of a hanger member for display of fishing rods in accordance with embodiments of the present invention.
Figure 7:
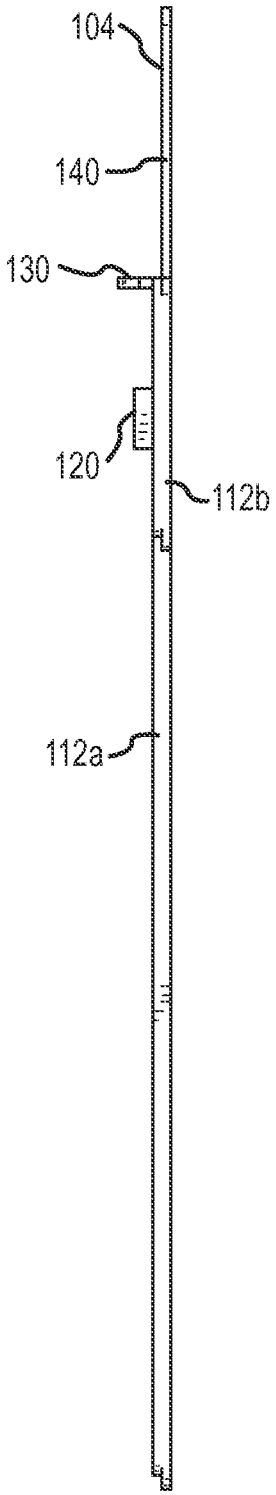
FIG. 7 is a left side elevation view of a hanger member for display of fishing rods in accordance with embodiments of the present invention.
Figure 8:
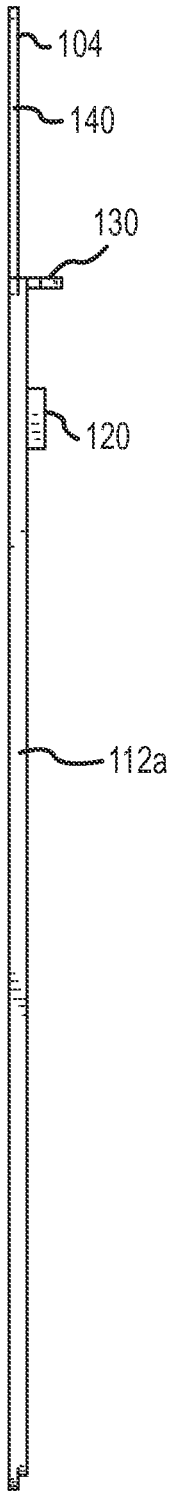
FIG. 8 is a right side elevation view of a hanger member for display of fishing rods in accordance with embodiments of the present invention.
Figure 9:
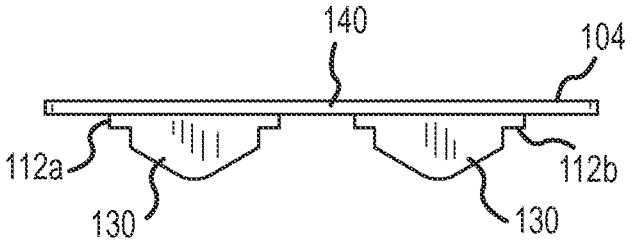
FIG. 9 is a top elevation view of a hanger member for display of fishing rods in accordance with embodiments of the present invention.
Figure 10:
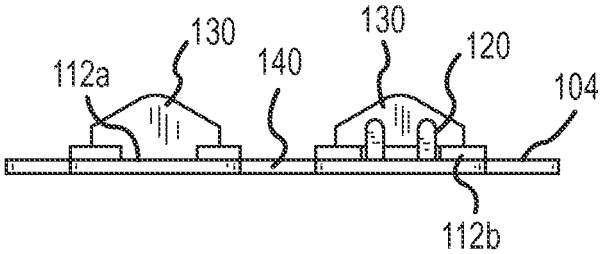
FIG. 10 is a bottom elevation view of a hanger member for display of fishing rods in accordance with embodiments of the present invention.

FIG. 4 is a front perspective view of a hanger member 104 in accordance with embodiments of the present invention. In this view, the fastener holes 116 formed in the first rail 112*a* can clearly be seen. In particular, it is apparent that the fastener holes 116 can comprise slots that are arranged in pairs at intervals along the length of the first rail 112*a*. Accordingly, in this embodiment, the fastener holes 116 are particularly adapted to receive zip type fasteners. By providing the fastener holes 116 at different locations along the length of the first rail 112*a*, rods 108 with guides 128 at different locations relative to the end of the rod 108 section held in the first rail 112*a* can be accommodated and securely attached to the hanger member 104. The second rail 112*b* in this illustrated embodiment includes an integrated fastener member 120 that, in this example, comprises a clip. More particularly, the integrated fastener 120 is sized to receive a tip section 114 of a rod 108. For example, the integrated fastener 120 can receive the tip section 114 of a rod, such that the tip guide 132 (see FIG. 1) is held between the integrated fastener 120 and the stop plate 130 associated with the second rail 112*b*.

FIGS. 5, 6, 7, 8, 9 and 10 are front, back, left side, right side, top, and bottom views respectively of the exemplary hanger member 104 illustrated in FIG. 4.

In accordance with further embodiments of the present invention, each rail 112 can include fastener holes 116 and/or integrated fasteners or fastener members 120. Moreover, fastener holes 116 are not limited to slot pairs. For example, a fastener hole 116 may comprise a round hole or pair of round holes adapted to receive a wire tie. In accordance with still other embodiments, fastener holes 116 may be provided in the form of open slots formed along one or more side edges of a rail 112, that are sized to receive a tie member. Other examples of fastener holes 116 include round holes for receiving self tapping screws that secure clips or other members around an interconnected rod 108 section. The hanger member 104 may be formed from a molded material. For example, the hanger member 104 may be formed from an injection molded plastic.

The foregoing discussion of the invention has been presented for purposes of illustration and description. Further, the description is not intended to limit the invention to the form disclosed herein. Consequently, variations and modifications commensurate with the above teachings, within the skill or knowledge of the relevant art, are within the scope of the present invention. The embodiments described hereinabove are further intended to explain the best mode presently known of practicing the invention and to enable others skilled in the art to utilize the invention in such or in other embodiments and with various modifications required by the particular application or use of the invention. It is intended that the appended claims be construed to include alternative embodiments to the extent permitted by the prior art.

What is claimed is:

1. A fishing rod hanging system, comprising:

a hanger plate;

a first rail extending from the hanger plate, wherein the first rail includes a plurality of fastener holes, and wherein the plurality of fastener holes of the first rail are arranged in a plurality of pairs;

a second rail extending from the hanger plate, wherein the second rail includes an integrated fastener, wherein the first rail is parallel to the second rail, wherein the first rail has a first length, wherein the second rail has a second length, and wherein the first length is greater than the second length.

2. The system of claim 1, wherein the plurality of fastener holes of the first rail include a plurality of slots.

3. The system of claim 2, wherein the first rail does not include any integrated fasteners, and wherein the second rail does not include any fastener holes.

4. The system of claim 1, wherein the hanger plate includes a hanger aperture.

5. The system of claim 4, wherein the hanger plate additionally includes a display area.

6. The system of claim 5, wherein the display area includes a planar surface located between the hanger aperture and the first and second rails.

7. A fishing rod hanging system, comprising:

a hanger plate:

a first rail extending from the hanger plate, wherein the first rail includes at least one of a fastener hole and an integrated fastener;

a second rail extending from the hanger plate, wherein the second rail includes at least one of a fastener hole and an integrated fastener, wherein the first rail is parallel to the second rail, wherein the first rail has a first length, wherein the second rail has a second length, and wherein the first length is greater than the second length;

at least a first fishing rod section interconnected to the first rail; and at least a second fishing rod section interconnected to the second rail.

8. The system of claim 7, further comprising a plurality of fasteners, wherein the first rail includes a plurality of pairs of fastener holes, wherein a first pair of the plurality of pairs of fastener holes of the first rail receive a first fastener of the plurality of fasteners to interconnect the first fishing rod section to the first rail at a first location, wherein a second pair of the plurality of pairs of fastener holes of the first rail receive a second fastener of the plurality of fasteners to interconnect the first fishing rod section to the first rail at a second location.

9. The system of claim 8, wherein the second rail includes the integrated fastener, wherein the second fishing rod section is interconnected to the second rail by the integrated fastener of the second rail.

10. The system of claim 9, further comprising:

at least a third fishing rod section interconnected to the first rail, wherein the third fishing rod section is interconnected to the first rail by at least the first and second fasteners.

11. The system of claim 7, further comprising:

an auxiliary package interconnected to the first and second fishing rod sections.

12. The system of claim 11, further comprising:

at least one accessory item enclosed in the auxiliary package.

13. A fishing rod hanging system, comprising:

a hanger plate;

a first rail extending from the hanger plate for a first length, wherein the first rail includes at least two pairs of fastener holes;

a second rail extending from the hanger plate for a second length, wherein the second rail includes at least one integrated fastener, wherein the first rail is parallel to the second rail, and wherein the first length is greater than the second length;

a first fastener received by a first one of the pairs of fastener holes;

a second fastener received by a second one of the pairs of fastener holes;

at least a first fishing rod section interconnected to the first rail by the first and second fasteners;

at least a second fishing rod section interconnected to the second rail by the integrated fastener.

14. The system of claim 13, further comprising:

an auxiliary package interconnected to the first and second fishing rod sections.

15. The system of claim 14, wherein the auxiliary package is not in direct contact with the hanger plate, the first rail, or the second rail.

16. The system of claim 15, wherein the auxiliary package is a blister type package that holds at least a first accessory item.

17. The system of a claim 13, wherein the hanger plate, the first rail, and the second rail are formed from the same piece of material.

* * * * *